US008968641B2

(12) United States Patent
Zhao

(10) Patent No.: US 8,968,641 B2
(45) Date of Patent: Mar. 3, 2015

(54) POROUS METALLIC MATERIALS AND METHOD OF PRODUCTION THEREOF

(75) Inventor: Yuyuan Zhao, Liverpool (GB)

(73) Assignee: The University of Liverpool, Liverpool (GB)

( * ) Notice: Subject to any disclaimer, the term of this patent is extended or adjusted under 35 U.S.C. 154(b) by 1169 days.

(21) Appl. No.: 11/569,641

(22) PCT Filed: May 19, 2005

(86) PCT No.: PCT/GB2005/001951

§ 371 (c)(1),
(2), (4) Date: Jan. 2, 2007

(87) PCT Pub. No.: WO2005/118186

PCT Pub. Date: Dec. 15, 2005

(65) Prior Publication Data

US 2007/0264152 A1 Nov. 15, 2007

(30) Foreign Application Priority Data

May 29, 2004 (GB) ..... 0412125.7

(51) Int. Cl.
*B22F 3/11* (2006.01)
*B22F 3/16* (2006.01)

(52) U.S. Cl.
CPC ..... *B22F 3/1134* (2013.01)
USPC ..... 419/2; 419/54; 419/55

(58) Field of Classification Search
USPC ..... 419/2, 26, 29, 30, 32, 36–43, 53–55; 75/228–250, 255, 252, 253, 254, 415, 75/746–773; 428/544, 546, 547, 550, 566
See application file for complete search history.

(56) References Cited

U.S. PATENT DOCUMENTS 2,935,396 A * 5/1960 Pashak ..... 419/38
3,087,807 A * 4/1963 Allen et al. ..... 75/415

(Continued)

FOREIGN PATENT DOCUMENTS

DE 1 972 961 * 11/1998 ..... C22C 1/08
JP 52085006 A2 7/1977
WO WO 2004/039748 A 5/2004

OTHER PUBLICATIONS

Wen, C.E.; Yamada, Y.; Shimojima, K.; Chino, Y.; Asahina, T.; Mabuchi, M. "Processing and mechanical properties of autogenous titanium implant materials," Journal of Materials Science: Materials in Medicine, 13 (2002), pp. 397-401.*

(Continued)

*Primary Examiner* — Scott Kastler
*Assistant Examiner* — Vanessa Luk
(74) *Attorney, Agent, or Firm* — Fox Rothschild LLP

(57) ABSTRACT

The present invention relates to a process for producing porous metallic materials comprising the steps of: (a) miming metallic particles with a carbonate additive and a binder, wherein the quantity of carbonate additive in the mixture is in the range of 40 to 90 vol % and compressing the mixture beyond the yield strength of the metallic particles; (b) heating the mixture to a first temperature sufficient to evaporate the binder; (c) heating and maintaining the temperature of the mixture to a second temperature sufficient to sinter the metallic particles but insufficient to decompose or melt the carbonate additive; (d) removing the carbonate additive from the sintered porous metallic material; and optionally (e) heating and maintaining the temperature of the porous metallic material to a third temperature greater than the second temperature so as to enhance the sintering. The present invention also relates to metallic materials produced by such a process.

17 Claims, 2 Drawing Sheets

(56) References Cited

U.S. PATENT DOCUMENTS

| | | | | |
|---|---|---|---|---|
| 3,627,520 | A * | 12/1971 | Rogers | 419/2 |
| 3,630,784 | A * | 12/1971 | Kuhn et al. | 419/2 |
| 6,080,357 | A * | 6/2000 | Sugikawa | 419/2 |
| 6,117,592 | A * | 9/2000 | Hoshino et al. | 429/235 |
| 6,254,998 | B1 * | 7/2001 | Tuchinsky | 428/567 |
| 6,849,230 | B1 * | 2/2005 | Feichtinger | 420/417 |
| 2004/0081571 | A1 * | 4/2004 | Vatchiants | 419/2 |

OTHER PUBLICATIONS

Alman, David E. and Jeffrey A. Hawk "Binder-Assisted Extrusion," vol. 7: Powder Metal Technologies and Applications, ASM Handbooks Online, ASM International, 2002, 28 pages total.*

"Magnesium ZK61A," Alloy Digest, Engineering Alloys Digest, Oct. 1969, 2 pages total.*

Patnaik, Pradyot, "Magnesium Carbonate," Handbook of Inorganic Chemicals, McGraw-Hill, 2003, pp. 518-521.*

Kayser, F.X. and M.S. Rashid "Apparatus for extruding wires of soft metals under vacuum or inert atmospheres," Review of Scientific Instruments, 49(5), May 1978, pp. 639-642.*

Hawley's Condensed Chemical Dictionary, 14th edition, John Wiley & Sons, 2002, entry: "polyvinyl alcohol".*

"AL 200 and AL 201 Alloys," Alloy Digest, Nov. 1988, 2 pages total.*

Eisenmann, Mark, "Porous Powder Metallurgy Technology: Processing Methods," vol. 7: Powder Metal Technologies and Applications, ASM Handbooks Online, ASM International, 2002. (9 pages total).*

Ferguson, B. Lynn and Randall M. German, "Powder Shaping and Consolidatin Technologies: Powder Compaction Methods," vol. 7: Powder Metal Technologies and Applications, ASM Handbooks Online, ASM International, 2002. (7 pages total).*

Handbook of Pharmaceutical Additives, Third Edition, Synapse Information Resources, 2008, pp. 1884-1990, properties of polyethylene glycol (p. 1903-1904).*

Zhao et al., "Lost carbonate sintering process for manufacturing metal foams," Scripta Materialia, 52, 2005, pp. 295-298.*

Bram et al., "High-Porosity Titanium, Stainless Steel, and Superalloy Parts," Advanced Engineering Materials, 2, No. 4, 2000, pp. 196-199.*

Sun et al., "Static and Dynamic Energy Absorption of Al Foams Produced by the Sintering and Dissolution Process," Metallurgical and Materials Transactions B, vol. 34B, Feb. 2003, pp. 69-74.*

Zhao, "Stochastic Modeling of Removability of NaCl in Sintering and Dissolution Process to Produce Al Foams," Journal of Porous Materials, 10, 2003, pp. 105-111.*

Zhao et al., "Optimisation of compaction and liquid-state sintering in sintering and dissolution process for manufacturing Al foams," Materials Science and Engineering A, 364, 2004, pp. 117-125.*

Sun et al., "Simulation of thermal diffusivity of Al/NaCl powder compacts in producing Al foams by the sintering and dissolution process," Journal of Materials Processing Technology, 169, 2005, pp. 83-88.*

Zhao et al., "Optimisation of compaction and liquid-state sintering in sintering and dissolution process for manufacturing Al foams," Materials Science and Engineering A, 364, Jan. 2004, pp. 117-125, publishing information included.*

Hawley's Condensed Chemical Dictionary, 14th edition, John Wiley & Sons, 2002, terms: iron, paraffin wax, tantalum.*

Joan L. Tomsic, editor, Dictionary of Materials and Testing, Second Edition, Society of Automotive Engineers, 2000, pp. 201-213.*

Zhao et al, "Novel sintering-dissolution process for manufacturing Al foams", Scripta Materialia vol. 44, No. 1, pp. 105-110 (2001).

Laptev et al, "Study of production route for titanium parts combining very high porosity and complex shape" Powder Metallurgy vol. 47, No. 1 pp. 85-92 (2004).

* cited by examiner

POROUS METALLIC MATERIALS AND METHOD OF PRODUCTION THEREOF

In accordance with the present invention, there is provided a process for producing porous metallic materials having interconnecting pores.

Porous metals, which are also called cellular metals or metal foams, can be used for lightweight and sandwich structures, energy absorption, mechanical damping, thermal management, sound absorption, filtration, electrical screening, catalyst supports, and combinations of these functions. Examples of their applications include lightweight panels for building and transport against buckling and impact, non-flammable ceiling and wall panels for thermal and sound insulation, heat exchangers, filters, catalyst carriers and scaffolds for tissue regeneration.

There currently exist a wide range of manufacturing methods for cellular metals. The main methods can generally be grouped into several categories according to the forms of the precursory metals and the types of the pore-forming agents.

By the melt-gas injection route, air or an inert gas is blown into the molten metal and dispersed by an impeller. The generated liquid foam floats to the surface of the melt and is gradually pulled off by a conveyor and solidifies to form a continuous sheet of metal foam. This route is characterised by a low production cost. The controllability over the size and distribution of the pores, however, is very poor. The foams usually consist of large and inhomogeneous pores and are only suitable for limited applications.

In the melt-foaming agent process, a foaming agent (usually $TiH_2$) is added to the molten metal. The gas released from the decomposition of the agent blows up the melt, which subsequently solidifies to form a porous structure. This route may be used to produce net shape foam structures with a relatively low cost. However, poor control over the size and distribution of the pores remains a problem. To obtain a reasonably homogeneous pore structure, additional agents have to be added to the melt to increase the viscosity or other more sophisticated procedures have to be adopted.

In the powder-foaming agent process, a compact of the mixture of metal and hydride powders is processed into a semi-finished product by a conventional deformation technique, which is then heated to near or above the melting point of the metal, which expands into a cellular structure under the pressure of the released gas. The pore sizes and distribution can be controlled to some extent but the controllability is still poor.

In the investment casting route, a polymer foam with open cells is first filled with a slurry of heat resistant materials and the coating formed is allowed to dry. The polymer is then removed, forming a ceramic mould. Molten metal is cast into the mould and allowed to solidify. After removal of the mould material, a metal foam is obtained which represents exactly the original structure of the polymer foam.

The investment casting route can produce metal foams of the highest quality, but the production cost is extremely high.

A porous metal structure can also be produced by melt infiltration, which relies upon molten metal being infiltrated into a preform, which is usually a compact of sodium chloride particles or other filler materials. After the liquid metal solidifies, the preform is dissolved in water or other solvents, leaving a porous foam structure. Melt infiltration is a low cost method but the porosity range attainable is relatively narrow.

A sintering and dissolution process has also been developed for manufacturing net-shape, open-celled aluminium foams. In this process, an Al powder is first mixed thoroughly with a NaCl powder at a pre-specified volume ratio. The resultant Al—NaCl powder mixture is compacted into a net-shape preform under an appropriate pressure. The preform is then sintered at a temperature either above or below the melting point of Al (660° C.) but far below that of NaCl (801° C.). After the Al in the preform forms a well-bonded networked structure, the preform is cooled to room temperature. The imbedded NaCl particles are finally dissolved in water, leaving behind an open-celled Al foam with the same chemical composition as that of the original Al powder.

The method of metal deposition relies upon the metal being deposited onto a polymer foam precursor via physical vapour or electrochemical deposition. The polymer foam is then burned off to produce a porous metal. This route is characterised by low productivity and high cost.

Porous metal materials can also be produced by sintering hollow metal spheres to form a close-celled cellular metal. This route is limited by the availability of hollow spheres and is also limited to close cells.

A metal-gas eutectic method of producing porous metal materials is also known which utilises a liquid metal that is solidified with a eutectic gas. This route has very limited applications because only a few metals can form eutectics with gases under conditions difficult to achieve in production.

Recently, highly porous titanium parts that have a complex shape has been described which enhances the strength of the unsintered compacts allowing machining in the green state (Laptev, A. et al., (2004) *Powder Metallurgy,* 47, (1), 85-92). In producing the parts, titanium and ammonium bicarbonate/carbamide are mixed together prior to sintering in a vacuum at a temperature in the range of 1200° C. and 1300° C. As both carbamide and ammonium bicarbonate dissociate at 200° C., they are soft and it is hard to control pore shape in addition to disassociating into non-environmental friendly gases.

There are a number of problems associated with the existing processes for producing porous metal materials, such as being labour intensive and/or costly. The liquid state routes generally have lower costs but are only suitable for low melting-point metals such as aluminium and magnesium. The solid and gas state routes are more expensive but can be used for a wide range of metals and their alloys, such as copper, steel, nickel cobalt, chromium, molybdenum or tin. Additionally, it would be advantageous for a process to be able to produce a porous material whose interconnected pores are open without the need to tool the material first as is the case with a number of materials produced by the prior art processes. It is also difficult to control both the pore size and the porosity of the material produced in prior art methods and therefore it would be most desirable to be able to control pore structure itself, such as pore size for example.

In accordance with the present invention, there is provided a process for producing porous metallic materials comprising the steps of:

(a) mixing metallic particles with a carbonate additive and a binder, wherein the quantity of carbonate additive in the mixture is in the range of 40 to 90 vol % and compressing the mixture beyond the yield strength of the metallic particles;

(b) heating the mixture to a first temperature sufficient to evaporate the binder;

(c) heating and maintaining the temperature of the mixture to a second temperature sufficient to sinter the metallic particles but insufficient to decompose or melt the carbonate additive;

(d) removing the carbonate additive from the sintered porous metallic material; and optionally (e) heating and maintaining the temperature of the porous metallic material to a third temperature greater than the second temperature so as to enhance the sintering.

The present invention therefore provides a process for producing porous metals or metal alloys (or cellular metals, or metal foams), the pores of which are open and interconnected. The process also provides the ability to control pore size, porosity and pore distribution.

The temperature of the mixture in step (b) may be attained slowly at a temperature typically lower than 500° C. to allow for the gradual evaporation and complete removal of the binder. Although, the exact temperature will depend largely upon the temperature at which the binder evaporates.

Should the metallic particles have a lower melting point than the carbonate additive, the second temperature may be chosen as that normally used for the sintering of the metallic material. Preferably, the second temperature is 10-100° C. below the melting point of the metallic material. More preferably, the temperature is 10-20° C. below the melting point of the metallic material. The second temperature can be 10-20° C. above the melting point of the metallic material in order to enhance the sintering by operating in the liquid or semi-liquid state.

The yield strength should be understood to mean the stress required to produce a very slight yet specified amount of plastic deformation, typically a strain of 0.0002. It will be obvious to one skilled in the art that the yield strength of the metallic particles will be largely determined by the composition of the metallic particles themselves. For example, the yield strengths of a few common metals and typical alloys are listed below:

Aluminium: 35 MPa;
Copper: 69 MPa;
Iron: 130 MPa;
Nickel: 138 MPa;
Titanium (commercially pure, annealed): 170 MPa;
Aluminium alloy (2024, annealed): 75 MPa;
Steel (1020): 180 MPa;
Stainless steel 316 (hot finished and annealed): 205 MPa;
Brass (70 Cu-30 Zn): 75 MPa; and
Titanium alloy (Ti-6 Al-4V annealed): 830 MPa.

It will be apparent to one skilled in the art that the temperature used for the sintering of metals and alloys is not a specific temperature, but a range of temperatures in which sintering of the metal and alloys will occur (depending on compactness of performs and particle size etc.).

Should the metallic particles have a higher melting point than the carbonate additive, the second temperature is preferably 10-100° C. below the melting or decomposition point of the carbonate. More preferably, the temperature is 10-20° C. below the melting or decomposition point of the carbonate. The second temperature will preferably be at the higher area of the sintering temperature range, without the carbonate being melted or decomposed, and therefore permit sintering to proceed more effectively.

Step (d) may comprise the steps of: (f) allowing the material to cool; and (g) dissolving and removing the carbonate in an aqueous solution. Such an aqueous solution may be water or any other solution in which the carbonate additive may dissolve and such a solution will depend upon the carbonate used. After the carbonate additive has been dissolved, the porous metallic material may also be allowed to dry under normal conditions or heated gently to assist in the drying of the material.

Should the metallic particles have a higher melting point than the carbonate additive, step (d) may also comprise the step of: (h) increasing the temperature of the material to a temperature sufficient to melt the carbonate additive, or may further comprise the step of; (i) increasing the temperature of the material to a temperature sufficient to decompose the carbonate into a gas and/or an ash.

The optional step (e) may only be necessary if the melting point of the metallic particles have a higher melting point than the carbonate additive and the sintering at the second temperature is deemed insufficient. In the sintering of metals, the sintering temperature and time need to be sufficient to ensure a strong bonding between the metal particles. Usually, the higher the temperature the better, and the higher the temperature the shorter the time needed for sintering to take place. As the second temperature is limited by the melting point of the carbonate additive, heating the mixture to a higher temperature (the third temperature) can considerably shorten the overall sintering time. The second temperature can be used to form initial bonding between the metal particles to prevent the structure from collapsing after the carbonate is removed. The third temperature can be used to achieve full bonding of the metallic particles. The introduction of step (e) can improve the bonding between the metallic particles and shorten the production time.

The process can be used to produce materials having interconnected pores and these pores can have a rough structure. Commonly, the porosity of the material will be in the region of 50-90%, and the porosity can be varied depending upon the ratio of carbonate additive to metallic particles. The porosity of the final product is roughly equal to the volume percentage of the carbonate in the mixture.

The metallic particles may comprise any metal or metal alloy. Preferably, the metallic particles comprise a metal or an alloy of one or more of the following group: titanium, copper, aluminium, magnesium, iron or nickel. The term "carbonate" includes a number of carbonates, such as calcium carbonate, magnesium carbonate, potassium carbonate and sodium carbonates, but does not include carbamides or bicarbonates. The carbonate additive is the pore forming agent. It is preferred that widely available and inexpensive carbonates are employed in the process such as one or a mixture selected from the following group: potassium carbonate (melting point 891° C.) or sodium carbonate (melting point 851° C.).

Preferably, the metallic particles are in the size range of 5 to 500 microns, however, particles up to 1.5 mm could also be employed depending upon the application that the material is to be used for and the pore size required. The metallic particles can be in any shapes or sizes. However, spherical or near spherical particles are compacted and sintered more readily and are therefore preferable. Best results have been obtained when the majority of the metallic particles are smaller than the carbonate particles so that the metallic particles can fill easily into the interstices between the carbonate particles. Thus, the shapes of the pores in the final porous product closely match those of the carbonate particles. The carbonate additive may be in a granular or powder form and may have a like for like size of the metallic particles, but may alternatively be of a different size. The shapes and sizes of the carbonate powder particles can be selected according to the intended shapes and sizes of the pores in the porous material. The particles can be spherical or irregular. The ratio of the metallic particles to carbonate additive may be used to determine or engineer the characteristics of the pores (such as porosity and pore size for example).

Preferably, the quantity of carbonate additive in the mixture is in the range of 40 to 90 vol % and this will approximately relate to the production of a material with a porosity of 40 to 90%. Of course, the precise porosity will not be exactly the same as the volume percentage of carbonate additive in the mixture and will vary depending upon the compaction and sintering conditions. This is because there is always a small amount of porosity in the compacted performs, typically in the region of 5-10%, which will be decreased to below 5% during sintering due to shrinkage.

Preferably, the metallic particles are mixed with a carbonate powder at a pre-specified volume ratio. The addition of the binder helps to prevent the powders from segregation and to ensure homogeneous mixing. Any organic liquid that does not react with the carbonate can be used as the binder. The binder may be an organic liquid (which may be volatile) and may comprise one or a mixture chosen from the following group: methanol, ethanol, kerosene, glycol, glycerine and polyvinyl alcohol. Preferably, the quantity of the binder in the mixture is in the range of 0.1 to 5%. More preferably, the quantity of the binder in the mixture is in the range of 0.5 to 2.5%. The preferred quantity of the binder is approximately 1% of the mixture.

It will be apparent to one skilled in the art that the mixture may be used to produce a preform prior to heating. Preferably, the mixture is compacted into a perform in a mould or die and is then heated in a furnace or similar heating apparatus. After the metallic particles have been bonded and the carbonate additive has been removed, a porous metallic component is produced. A near-net-shape porous material can be produced by using a proper mould or dies in the compaction stage. The compression pressure may be higher than the yield strength of the metal or alloy so that the metal or alloy particles undergo substantial plastic deformation and the porosity in the metal-carbonate preform is reduced. A lower compression pressure will also work however. The preform may be sintered in a vacuum or under a protective atmosphere in a normal electrical furnace or similar heating apparatus. The exact sintering process will depend on the metal, or alloy, and the carbonate used.

In an embodiment of the present invention, a copper-potassium carbonate preform in accordance with the present invention may be sintered at 850° C. In another embodiment of the present invention, a copper-potassium carbonate preform in accordance with the present invention may be sintered at 850° C. and then at 950° C. In yet another embodiment of the present invention, a steel-potassium carbonate preform in accordance with the present invention may be sintered at 850° C. and then at 950° C. The sintering time will be selected according to the geometry and size of the preform.

In accordance with a further aspect of the present invention, there is provided metallic porous material produced by the process as herein described above. The porosity of the material may be in the range of 40 to 90% and the porosity will depend upon the ratio of the carbonate additive to metallic particles. The pores are open in the fact that most of the carbonate particles are networked and can therefore be removed after the sintering. Blockage of the underside of the preform should also normally be avoided so that the molten carbonate can flow freely out of the preform if appropriate. Furthermore, a container may be placed below the preform to collect the molten carbonate. Any residual ashes (if present) in the material can be blown off by compressed air. The pores may also have a rough structure.

The metallic porous material may be used to produce a wide range of products in a number of different fields and this will be appreciated by one skilled in the art. In particular, the material may be used to produce medical implants such as synthetic bones and structures and it will be apparent that the use of titanium in such an implant would be most beneficial as tissue can bond with the titanium in addition to cellular titanium having similar weight and strength properties of bone. The material may also be used as a sound absorbing material for musical studios and mechanical instillations, in addition to structural members for the aerospace and automotive industries to name a few (using an aluminium porous material for example). The material would also provide a heat sink material for cooling apparatus such as a computer or a piece of machinery (using a porous copper material for example) and this may be in conjunction with a cooling liquid. Screening material could also be produced from the material for screening from electromagnetic radiation for example (using a porous steel material). It can also be envisaged that the porous materials can also be used in catalyst reactions for a substrate on which the catalyst can be bonded or held or even the material itself acting as the catalyst if appropriate.

The present invention will now be described by example only with reference to the following examples and figures.

The following process allows for considerable variability within the exact protocol to accommodate for different metals or alloys (including alloys of the same metal) in addition to different pore sizes and particle sizes of metal/alloy and carbonate additives.

EXAMPLE 1

An experiment was conducted to produce a copper porous material having interconnected pores. Table 1 below shows the quantities of the ingredients of the mixture prior the mixture being compacted into a preform and heated.

TABLE 1

| Raw Material | Copper Powder | Potassium Carbonate Powder | Binder (Ethanol) |
|---|---|---|---|
| Particle size range (μm) | 20-53 | 53-125 | |
| Volume percentage (%) | Balance | 70 | 1 |

The mixture was placed in a mould and compacted under a pressure of 250 MPa. The preform was heated to 300° C. for 30 minutes to allow the binder to evaporate and then sintered at a temperature of 850° C. for 4 hours for a maximum section thickness of 20 mm. The sintered preform was allowed to cool to room temperature and the potassium carbonate was dissolved in flowing water at room temperature for 4 hours.

Figure 1:
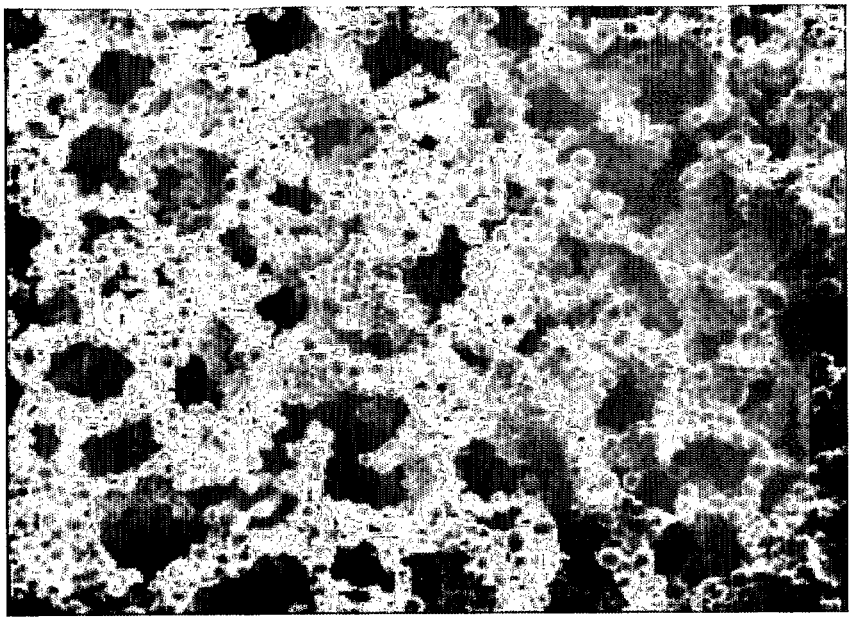
FIG. 1 is a scanning electron micrograph of a sample of the copper porous material produced in Example 1.
Figure 2:
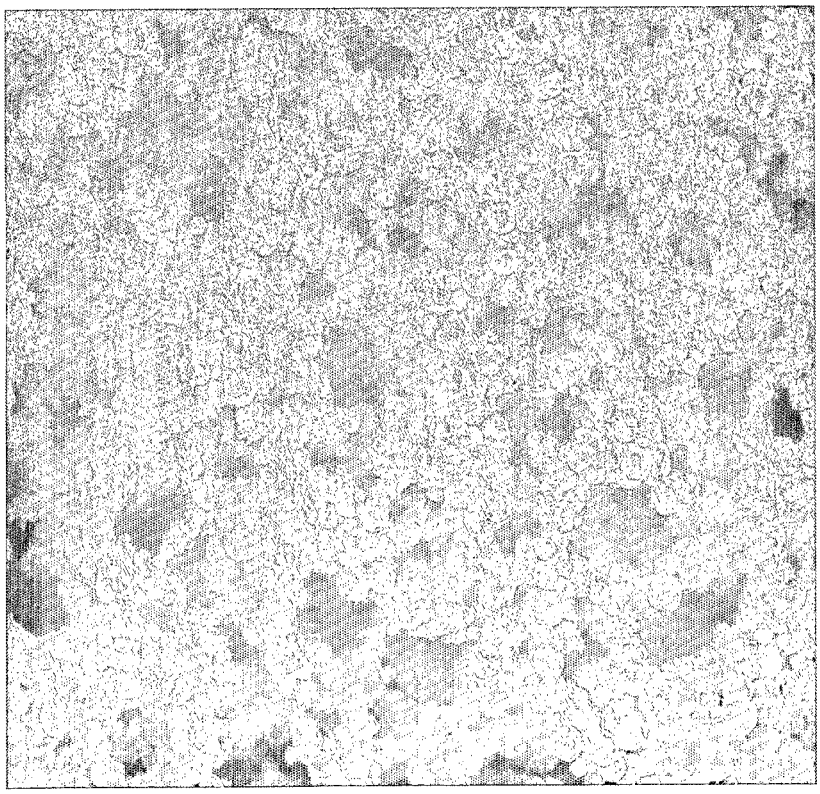
FIG. 2 is a second scanning electron micrograph of a sample of the copper porous material as produced in Example 1.

The interconnected pores of the material as produced in this experiment can be seen in FIGS. 1 and 2.

EXAMPLE 2

An experiment was conducted to produce a copper porous material having interconnected pores. Table 2 below shows the quantities of the ingredients of the mixture prior the mixture being compacted into a preform and heated.

TABLE 2

| Raw Material | Copper Powder | Potassium Carbonate Powder | Binder (Ethanol) |
|---|---|---|---|
| Particle size range (μm) | 20-53 | 425-710 | |
| Volume percentage (%) | Balance | 70 | 1 |

The mixture was placed in a mould and compacted under a pressure of 200 MPa. The preform was partially sintered at a temperature of 850° C. for 1 hour to allow the formation of initial bonding between the metal particles. The preform was then sintered at a higher temperature of 1000° C. for 3 hours for a maximum section thickness of 20 mm.

Figure 3:
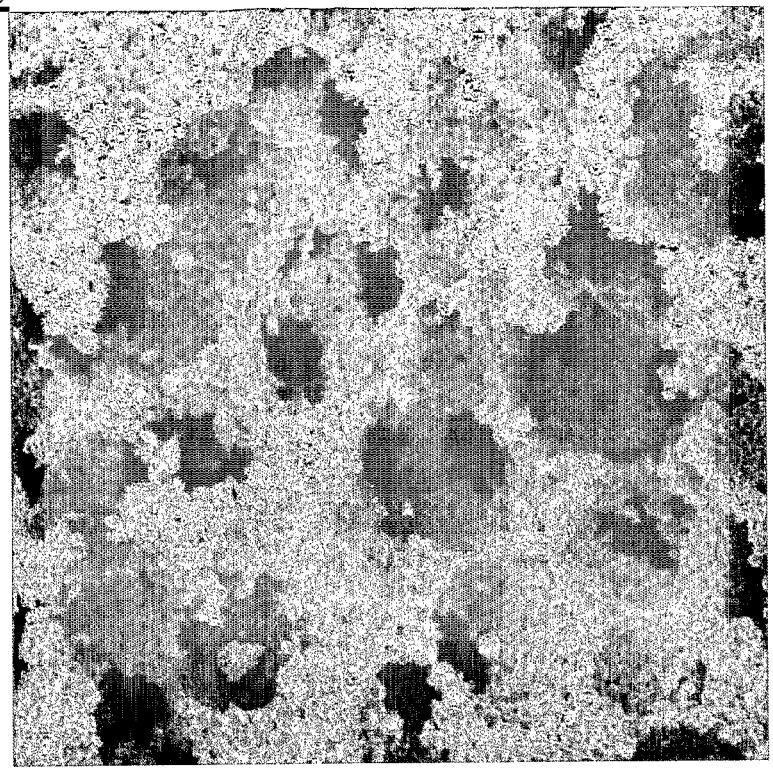
FIG. 3 is a scanning electron micrograph of a sample of the copper porous material as produced in Example 2.

The interconnected pores of the material as produced in this experiment can be seen in FIG. 3.

EXAMPLE 3

An experiment was conducted to produce a steel porous material having interconnected pores. Table 3 below shows the quantities of the ingredients in the mixture prior the mixture being compacted into a preform and heated.

TABLE 3

| Raw Material | Steel Powder | Potassium Carbonate Powder | Binder (Ethanol) |
|---|---|---|---|
| Particle size range (μm) | 20-75 | 53-125 | |
| Volume percentage (%) | balance | 80 | 1 |

The powder mixture was compacted into a preform at a pressure of 250 MPa and partially sintered at 850° C. for 2 hours for a maximum section thickness of 20 mm. The partially sintering allowed a basic bonded structure to be produced. The preform was then subjected to a higher sintering temperature of 950° C. to completely sinter the metal powder for 2 hours for a maximum section thickness of 20 mm.

Figure 4:
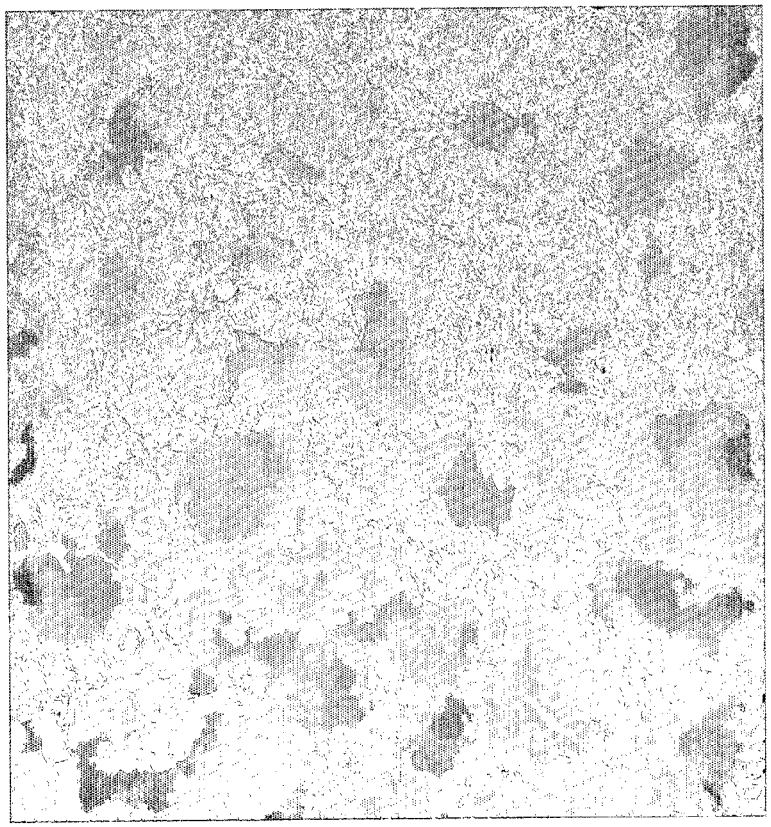
FIG. 4 is a scanning electron micrograph of a sample of the steel porous material produced in Example 3.

The interconnected pores of the material as produced in this experiment can be seen in FIG. 4.

EXAMPLE 4

An experiment was conducted to produce an aluminium porous material having interconnected pores. Table 4 below shows the quantities of the ingredients of the mixture prior the mixture being compacted into a preform and heated.

TABLE 4

| Raw Material | Aluminium Powder | Potassium Carbonate Powder | Binder (Ethanol) |
|---|---|---|---|
| Particle size range (μm) | 20-53 | 1000-2000 | |
| Volume percentage (%) | Balance | 70 | 1 |

The mixture was placed in a mould and compacted under a pressure of 200 MPa. The mixture was sealed by a thin layer of iron powder compressed at a pressure of 150 MPa. The perform, still in the mould, was heated to 690° C. at a heating rate of 10° C. per minute and maintained at 690° C. for 20 minutes to allow the aluminium particles to be bonded by liquid sintering. The sintered preform was allowed to cool to room temperature and the potassium carbonate was dissolved in flowing water at room temperature for 4 hours.

In all examples, a number of binders could be used in place of ethanol, such as kerosene, glycol, glycerine and polyvinyl alcohol.

The invention claimed is:

1. A process for producing porous metallic materials comprising the steps of:

a. homogeneously mixing a composition consisting of metallic particles, a carbonate additive and a binder, wherein the metallic particles have a higher melting point than the melting or decomposition point of the carbonate additive and the quantity of carbonate additive in the mixture is in the range of 40 to 90 vol % and compressing the mixture in a mould beyond the yield strength of the metallic particles, so as to bring about a plastic strain of at least 0.0002 and plastic deformation of the metallic particles;

b. heating the mixture to a first temperature sufficient to evaporate the binder;

c. heating and maintaining the temperature of the mixture to a second temperature sufficient to sinter the metallic particles but insufficient to decompose or melt the carbonate additive, sintering thereby occurring before removal of the carbonate additive;

d. allowing the material to cool and dissolving and removing the carbonate additive from the sintered porous metallic material prepared in step (c) in an aqueous solution in a manner that prevents the porous metallic material from collapsing after the carbonate additive is removed, so that the pores of said porous metallic material approximate the shape and size of the carbonate additive particles; and e. optionally heating and maintaining the temperature of the porous metallic material to a third temperature greater than the second temperature so as to enhance the sintering.

2. A process as claimed in claim 1, wherein the first temperature is less than or equal to 500° C.

3. A process as claimed in claim 1, wherein the aqueous solution comprises water.

4. A process as claimed in claim 1, wherein the materials have interconnected pores.

5. A process as claimed in claim 1, wherein the metallic particles comprise metal or metal alloy particles.

6. A process as claimed in claim 1, wherein the metallic particles comprise a metal or an alloy of one or more of the following group: titanium, copper or nickel.

7. A process as claimed in claim 1, wherein the carbonate comprises one or a mixture selected from the following group: potassium carbonate, sodium carbonate, magnesium carbonate or calcium carbonate.

8. A process as claimed in claim 1, wherein the metallic particles are in the size range of 5 to 500 microns.

9. A process as claimed in claim 1, wherein the carbonate additive is in a granular or powder form.

10. A process as claimed in claim 1, wherein the ratio of the metallic particles to carbonate additive is used to determine the characteristics of the pores.

11. A process as claimed in claim 1, wherein the binder is organic.

12. A process as claimed in claim 1, wherein the binder comprises one or a mixture chosen from the following group: methanol, ethanol, kerosene, glycol, glycerine and polyvinyl alcohol.

13. A process as claimed in claim 1, wherein the quantity of the binder in the mixture is in the range of 0.1 to 5 vol %.

14. A process as claimed in claim 1, wherein the mixture is used in a preform, mould or die prior to heating.

15. A process as claimed in claim 14, wherein the mixture is compacted into a preform, mould or die prior to heating.

16. A process as claimed in claim 1, wherein the mixture is heated under pressure.

17. A process as claimed in claim 1, wherein the mixture is heated in a vacuum.

* * * * *